US005983765A

United States Patent [19]

Sandford

[11] Patent Number: 5,983,765

[45] Date of Patent: Nov. 16, 1999

[54] ANVIL JACK

[76] Inventor: Peter Sandford, 47 Tweed Cresent, London Ontario, Canada, N5Y 1Z5

[21] Appl. No.: 08/907,075

[22] Filed: Aug. 6, 1997

[30] Foreign Application Priority Data

Aug. 13, 1996 [CA] Canada ..... 2183202

[51] Int. Cl.[6] ..... B26D 1/04; B26D 5/00

[52] U.S. Cl. ..... 83/641; 83/582; 83/681; 83/696

[58] Field of Search ..... 83/123, 582, 51, 83/681, 641, 696

[56] References Cited

U.S. PATENT DOCUMENTS

| | | |
|---|---|---|
| 455,015 | 6/1891 | Gilliland . |
| 2,071,055 | 2/1937 | Aff . |
| 2,078,569 | 4/1937 | Halstead . |
| 2,195,819 | 4/1940 | Kurtzeborn . |
| 2,313,801 | 3/1943 | Carll . |
| 2,390,072 | 12/1945 | Beaton . |
| 2,821,871 | 2/1958 | Sarno . |
| 2,860,555 | 11/1958 | Williamson . |
| 2,939,347 | 6/1960 | Tobey . |
| 2,939,358 | 6/1960 | Pearson . |
| 2,974,572 | 3/1961 | Shields . |
| 3,020,809 | 2/1962 | Guyer et al. . |
| 3,048,069 | 8/1962 | Berlin et al. . |
| 3,103,845 | 9/1963 | Porter et al. . |
| 3,122,048 | 2/1964 | Warner . |
| 3,150,550 | 9/1964 | Berlin et al. . |
| 3,166,968 | 1/1965 | Krouskop . |
| 3,170,342 | 2/1965 | Downie . |
| 3,171,319 | 3/1965 | Kyle . |
| 3,218,902 | 11/1965 | Berns et al. . |
| 3,292,513 | 12/1966 | Palmer . |
| 3,485,146 | 12/1969 | Sarka . |
| 3,524,370 | 8/1970 | Thompson . |
| 3,635,115 | 1/1972 | Ricken-Bacher . |
| 3,752,042 | 8/1973 | Castille . |
| 3,786,732 | 1/1974 | Forbes, Jr. . |
| 3,826,170 | 7/1974 | Jones et al. . |
| 3,869,949 | 3/1975 | Dolle . |
| 3,929,059 | 12/1975 | Gendron . |
| 3,982,458 | 9/1976 | Terasaka . |
| 4,151,768 | 5/1979 | Shockovsky . |
| 4,343,215 | 8/1982 | Fuchs . |
| 4,625,612 | 12/1986 | Oliver . |
| 5,027,509 | 7/1991 | Barben et al. . |
| 5,140,872 | 8/1992 | Holliday et al. . |
| 5,214,990 | 6/1993 | Ben-David et al. . |
| 5,429,577 | 7/1995 | Simpson et al. . |

FOREIGN PATENT DOCUMENTS

| | | |
|---|---|---|
| 198546 | 3/1920 | Canada . |
| 448699 | 5/1948 | Canada . |
| 597351 | 5/1960 | Canada . |
| 610389 | 12/1960 | Canada . |
| 655713 | 1/1963 | Canada . |
| 710631 | 6/1965 | Canada . |
| 960941 | 1/1975 | Canada . |
| 1001064 | 12/1976 | Canada . |
| 1180265 | 1/1985 | Canada . |
| 1312542 | 1/1993 | Canada . |

*Primary Examiner*—M. Rachuba
*Assistant Examiner*—Sean Pryor
*Attorney, Agent, or Firm*—Martin J. Marcus

[57] ABSTRACT

An apparatus and method are provided for die cutting both sides of paperboard sheets. The apparatus includes a die comprising a plurality of cutting knives projecting from a base, the cutting knives being set into a preselected pattern of grooves within the base. The die further includes a die blade mounted in the base, as well as an anvil, mounted in the base and oriented substantially parallel to the die blade. Securing elements secure at least one of the die blade and the anvil to the base. Manually-actuatable members are provided for adjusting the securing elements for selectively raising or lowering at least one of the selected die blade and the anvil. A back-up plate is provided to which the base is secured.

28 Claims, 7 Drawing Sheets

ANVIL JACK

BACKGROUND OF THE INVENTION (a) Field of the Invention

This invention relates to dies for forming cardboard cartons, particularly those having a so-called "reverse cut score".

Methods and apparatus are now known for die cutting paperboard. In addition, tear strips have been produced in paperboard cartons and the like by die cutting the paperboard from opposite sides thereof to provide removable areas which are defined by relatively widely spaced-out creases extending into one surface of the board and more closely spaced-out creases extending in parallel side-by-side relation to the first creases and extending into the opposite side of the sheet. When the intermediate area is grasped, the paperboard splits from one cut crease to the other to permit removal of the defined area. Under normal circumstances, this die-cutting operation is done by first die cutting one side of the sheet and then die cutting the opposite side of the sheet in a separate operation. This method has been followed using cutting presses which were normally provided with a die which was engageable with one side only of the sheet.

Conventionally, dies for cutting and creasing paperboard blanks have been made by setting steel rules for cutting the paperboard in a predetermined pattern between individually cut wood blocks, which are held in a steel frame by wooden wedges with the edges of the rules extending above the blocks. Small blocks of sponge rubber, or synthetic cork were generally placed on each side of the cutting rule to push the board free of the knives on completion of the cutting stroke. The creasing rules, in most systems, are glued to the wooden blocks. Other systems of dies are known in which the steel rules are inserted into grooves cut by jig saw into a slab of plywood of ¾ inch thickness in a predetermined pattern so that when the plywood die is brought to bear against the paperboard a blank of the desired configuration is stamped out.

In the formation of tear strips of the type employing a peripheral pair of die cut grooves in opposite sides of the paperboard, it was usual practice to have the die cuts or grooves extend approximately one-half of the thickness of the paperboard from either side thereof.

Patents exist directed to the scoring of sheet material. Canadian Patent No. 198,546 patented Mar. 23, 1920 by P.C. Simmons provided a blank cutting machine. In this patent, the sheet was supported above the cutting die, and the cutting block was reciprocated vertically with respect to the cutting die. The cutting die was mounted on a stationary bed, and was adjustably mounted on a carrier by means of a series of set screws. This was no suggestion of relative adjustable movement between the cutting die and the cutting block.

Canadian Patent No. 710,631 patented Jun. 1, 1965 by T. Coy provided a die structure. In that patent, the bed had a plateau which supported a male die having a peripheral shearing edge. The female die comprised a steel rule supported by a wood blank. On a downward stroke, the female steel rule blanked a shaped piece when the steel rule contacted the plateau. There was no suggestion of relative adjustable movement between the plateau and the female steel rule.

Canadian Patent No. 1,312,542 patented Jan. 12, 1993 by J. V. W. Memmott et al provided a method and apparatus for cutting sheets of material. In that patent, a cutting board was provided against which the cutting die cut the plies of sheets of material. There was no suggestion of relative adjustable movement between the cutting die and the cutting board.

U.S. Pat. No. 2,939,358 patented Jun. 7, 1960 by E. W. Pearson provided a ledger blade adjustment means for a shear machine. This patent taught a horizontal adjustment of the lower knife with respect to the upper knife, in order to adjust the clearance. This was brought about by adjustment of the table assembly which was accomplished by positioning, within the upper portion of each of the slots, a bearing block for altering the spacing between the abutment lug and the edge defined by the upper end of the slot. The bearing block was welded to the upper end of the abutment lug. A bearing pad engaged the upper edge of the slot in spaced relationship to the bearing block, with one or both opposing surfaces being angled slightly. A wedge was adapted to be driven between the bearing block and the bearing pad. Controlled movement of the wedge in making adjustments was necessary, as the movement at one end of the front wall must be duplicated at the other end with substantial accuracy. However, there was no suggestion of direct, infinitely-variable control of relative spacing of the anvil against which the die blade cooperated to provide a reverse score cut.

U.S. Pat. No. 3,020,809 patented Feb. 13, 1962 by R. Guyer et al (and its corresponding Canadian Patent No. 655,713 issued Jan. 8, 1963 to R. Guyer et al), provided apparatus for die cutting paperboard. The aim of the patentee was to provide an extremely accurate control of the depth of cut. To achieve such aim, the patentee provided an apparatus which included a fixed platen having a metal die cutting plate thereon, the plate having a flat outer surface. A lower die was provided which included die cutting edges which projected from the cutting plate. A movable platen cooperated with the fixed platen, and a wooden base was supported by the movable platen, the wooden base including a die cutting rule projecting therefrom. Metal inserts were provided in the die, the metal inserts being supported upon the movable platen against which die cutting edges which projected through the die cutting plate may operate. These inserts were so arranged that the exposed surface of the inserts were spaced from the surface of the die cutting plate by a distance which was substantially equal to the thickness of the paperboard being cut. As a result, over the specific areas of the die in opposed relation to the die cutting edges on the fixed platen, an extremely accurate control of the depth of cut was alleged to be obtained. However, there was no teaching of an infinitely-variable control since the control steps were limited to the finite thickness of the metal inserts.

U.S. Pat. No. 3,170,342 patented Feb. 23, 1995 by R. H. Dounee provided a method of making cutting dies. A one-piece metallic plate had a photographically-registered representation of the male scoring and cutting elements in extremely shallow relief on its upper surface. The main surface of the plate was chemically etched away so that the scoring and cutting elements stood in slight relief. A complementary one-piece metallic female die was also provided which included cutting elements and scoring elements which co-acted with those of the male die to form the scores and cut-lines of the finished carton blank. These elements were also photo-composed and in very shallow relief to the chemically-etched background surface of the metallic plate. The patentee taught that the vertical gap between the male and female die plates when the press was on impression was adjustable to about a percentage of the over-all thickness of the board, to range from a slight overlap. Such vertical gap was adjusted by adhesively securing the male scoring die plate to a base of suitable thickness, or by attaching a thin sheet of resilient material to the etched background of the female plate by double sided adhesive tape. Thus, there was no teaching of an infinitely-variable control of such vertical gap, since the control steps were limited to the finite thickness of the securing member.

U.S. Pat. No. 3,292,513 patented Dec. 20, 1966 by C. E. Palmer, provided apparatus for scoring sheet material. The patentee provided a die assembly including a rectangular frame within which scoring members and cutting blades were received, which were held in predetermined space relationship by wooden spacer elements. The frame assembly included scoring platen members and a cutting platen member. The scoring platen members were resiliently supported by the resilient support member and the cutting platen member was independently and rigidly supported by the metal blocks. Thus, while a depth control was provided, such depth control was by way of resilient supporting means. There was no teaching of an infinitely-variable control of the depth.

SUMMARY OF THE INVENTION (a) Aims of the Invention

In summary, therefore, in none of the patents disclosed above is there any suggestion or teaching that the platen or anvil should, or could, be controllably and infinitely-variably-vertically movable.

The main object of the present invention is to provide a die including a cutting plate having a so-called steel rule knives set therein in a preselected orientation, and which also include a vertically-adjustable anvil cooperating with an associated lower plate for the purpose of providing a reverse cut-score.

Yet another object of this invention is to provide such die with an adjustable die blade.

Still another object of this invention is to provide novel means for securing the die blade.

A further object of the present invention is to provide a novel structure for locking the adjustable anvil and/or the adjustable steel rule knife in any desired position adjustment.

(b) Statement of Invention

The system of the present invention provides the means for adjusting the depth or penetration of the reverse cut-score and standard cut-score knife used in the production of folding cartons. Prior to the development of the present invention, it was not feasible independently to adjust the penetration of such knives (cutting in opposing directions) as they were controlled by the tool short height which simultaneously moved both cutting knives.

Thus, the present invention provides an improvement in a die for use in an apparatus for die cutting both sides of paperboard sheets. The improvement resides in a die including a plurality of cutting knives projecting from a base plate, the knives being set into a preselected pattern of grooves within the base. The die further includes a die blade which is secured to in the base. An anvil is also secured to the base and is oriented substantially parallel to the die blade at least one of the die blade and the anvil is secured in a securing means combination, one supporting element of such combination supporting the at least one of the die blade and the anvil. An urging element of such combination urges the at least one of the die blade and the anvil in a downward direction. The securing means combination permits upward and downward movement of at least one of the die blade and the anvil relative to the base plate. Manually-actuatable means on the support element of the securing means combination are provided for adjusting and raising the supporting element against the reaction of the urging element for selectively raising of lowering the at least one of the selected die blade and the anvil.

The present invention also provides several embodiments of apparatus for die cutting paperboard sheets from opposite directions. In one embodiment, the apparatus includes two essential elements. The first essential element is a first platen, the first platen having secured thereto a plurality of dies, each die including a plurality of cutting knives projecting from a base plate, the knives being set into a pre-selected pattern of grooves within the base plate. A die blade is mounted in the base plate, and an anvil is also mounted in the base plate and is oriented substantially parallel to the die blade. Securing means secure at least one of the die blade and the anvil to the base. Manually-actuatable means is provided for adjusting at least one of those securing means for selectively raising or lowering at least one of the die blade or the anvil. A back-Lip plate is provided to which the base plate is secured. In this embodiment, the securing means may comprise two spaced-apart anvil blocks supporting the anvil, each of the anvil blocks being adjustably held to the base by an associated anvil block bolt, each anvil block bolt being threadedly-secured within, and extending through, an associated anvil block. The lower edges of the anvil rest on a lower step of each anvil block. An anvil spring plate is threadedly-secured to the base plate by a central bolt, the anvil spring plate being secured to the anvil by a slot in the anvil within which an edge of the anvil spring plate is disposed. The rotation of each such anvil block bolt tends to raise or lower an associated anvil block by reaction of an end of the anvil bolt against the back-tip plate. The raising of the anvil is accomplished by rotating the anvil block bolts, against the reaction of the anvil spring plate, and the lowering of the anvil is accomplished by rotating the anvil block bolts in an opposite direction, the reaction of the anvil spring plate urging the anvil downwardly, so that the anvil spring plate substantially continuously holds the anvil to the base. The rotation of each die blade block bolt tending to raise or lower an associated die blade block by reaction of an end of the die blade bolt against the back-up plate. The securing means may also, or alternatively, comprise two spaced-apart die blade blocks supporting the die blade, each of the die blade blocks being adjustably held to the base by an associated die blade block bolt, each die blade block bolt being threadedly-secured within, and extending through, an associated die blade block, the lower edges of the die blade resting on a lower step on each die blade block. A die blade spring plate is threadedly-secured to the base by a central bolt, the die blade spring plate being secured to the die blade by an indent punched out of the die blade upon which an edge of the die blade spring plate rests. The rotation of each die blade block bolt tends to raise or lower an associated die blade by reaction of an end of the die blade bolt against the back-up plate. The raising of the die blade is accomplished by rotating the die blade block bolts, against the reaction of the die blade spring plate, and the lowering of the die blade is accomplished by rotating the die blade bolts in an opposite direction, the reaction of the die blade spring plate urging the die blade downwardly. The second essential element includes a second platen, the second platen being cooperable with the first platen by relative movement therebetween to die cut paperboard sheets disposed therebetween. The second platen has a like plurality of die cutting plates secured thereto, each of the die cutting plates including a pair of spaced-apart cutting edges projecting therefrom, each of the cutting edges being aligned with an associated anvil of the die on the first platen. Each of the die cutting plates also includes a pair of spaced-apart pseudo-anvils thereon, the pseudo-anvils being aligned with an associated die blade of the die on the first platen.

In another embodiment, such apparatus includes two essential elements. The first essential element is a first platen, the first platen having secured thereto a plurality of dies, each die including plurality of cutting knives projecting from a base plate, the knives being set into a pre-selected pattern of grooves within the base plate. A die blade is mounted in the base plate and an anvil is also mounted in the base plate and is oriented substantially parallel to the die blade. Securing means secure the anvil to the base plate. Manually-actuatable means is provided for adjusting the securing means for selectively raising or lowering the anvil. A back-up plate is provided to which the base plate is secured. In this embodiment, the securing means comprises two spaced-apart anvil blocks supporting the anvil, each of the anvil blocks being adjustably held to the base plate by an associated anvil block bolt, each anvil block bolt being threadedly-secured within, and extending through, an associated anvil block. The lower edges of the anvil rest on a lower step on each anvil block. An anvil spring plate is threadedly-secured to the base by a central bolt, the anvil spring plate being secured to the anvil by a slot in the anvil within which an edge of the anvil spring plate is disposed. The rotation of each anvil block bolt tends to raise or lower an associated anvil block by reaction of an end of the anvil block bolt against the back-up plate. The raising of the anvil is accomplished by rotating the anvil block bolts, against the reaction of the anvil spring plate, and the lowering of the anvil is accomplished by rotating the anvil block bolts in an opposite direction, the reaction of the anvil spring plate urging the anvil downwardly. The anvil spring plate substantially continuously holds the anvil to the base. The second essential element includes a second platen, the second platen being cooperable with the first platen by relative movement therebetween to die cut paperboard sheets disposed therebetween, the second platen having secured thereto a like plurality of die cutting plates. Each die cutting plate includes a pair of spaced-apart cutting edges projecting therefrom. Each cutting edge is aligned with an associated anvil of the die on the first platen. A spaced-apart pair of pseudo-anvils is provided thereon, the pseudo-anvils being aligned with an associated die blade of the die on the first platen.

In another embodiment, such apparatus includes two essential elements. The first essential element is a first platen, the first platen having secured thereto a plurality of dies, each die including plurality of cutting knives projecting from a base plate, the knives being set into a pre-selected pattern of grooves within the base plate. A die blade is mounted in the base plate and an anvil is also mounted in the base plate and is oriented substantially parallel to the die blade. Securing means secure the anvil to the base plate. Manually-actuatable means is provided for adjusting the securing means for selectively raising or lowering the anvil. A back-up plate is provided to which the base is secured. Securing means also secure the die blade to the base plate and manually-actuatable means are provided for adjusting the securing means for selectively raising or lowering the die blade. The base plate is secured to the previously-mentioned back-up plate. In this embodiment, the securing means comprises two spaced-apart anvil blocks supporting the anvil, each of the anvil blocks being adjustably held to the base plate by an associated anvil block bolt, each anvil block bolt being threadedly-secured within, and extending through, an associated anvil block. The lower edges of the anvil rest on a lower step on each anvil block. An anvil spring plate is threadedly-secured to the base by a central bolt, the anvil spring plate being secured to the anvil by a slot in the anvil within which an edge of the anvil spring plate is disposed. The rotation of each anvil block bolt tends to raise or lower an associated anvil block by reaction of an end of an anvil block bolt against the back-up plate. The raising of the anvil is accomplished by rotating the anvil block bolts, against the reaction of the anvil spring plate, and the lowering of the anvil is accomplished by rotating the anvil block bolts in an opposite direction, the reaction of the anvil spring plate urging the anvil downwardly. The anvil spring plate substantially continuously holds the anvil to the base. The securing means also comprises two spaced-apart die blade blocks supporting the die blade, each of the die blade blocks being adjustably held to the base plate by an associated die blade block bolt, each die blade block bolt being threadedly-secured within, and extending through, an associated die blade block. The lower edges of the die blade rest on a lower step on each die blade block. A die blade spring plate is threadedly-secured to the base by a central bolt. The die blade spring plate is secured to the die blade by an indent punched out of the die blade upon which an edge of the die blade spring plate rests. The rotation of each die blade block bolt tends to raise or lower an associated die blade block by reaction of an end of the die blade bolt against the back-up plate. The raising of the die blade is accomplished by rotating the die blade block bolts, against the reaction of the die blade spring plate, and the lowering of the die blade is accomplished by rotating the die blade block bolts in an opposite direction, the reaction of the die blade spring plate urging the die blade downwardly. The die blade spring plate substantially continuously holds the die blade to the base. The second essential element includes a second platen, the second platen being cooperable with the first platen by relative movement therebetween to die cut paperboard sheets disposed therebetween, the second platen having secured thereto a like plurality of die cutting plates. Each die cutting plate including a pair of spaced-apart cutting edges projecting therefrom. Each cutting edge is aligned with an associated anvil of the die on the first platen.

In a still further embodiment, such apparatus comprises an apparatus for die cutting paperboard sheets. The apparatus includes a cylindrical shell, the cylindrical shell having secured thereto a plurality of dies. Each die includes a die blade secured to an arcuate base plate which is secured to the cylindrical shell. Securing means secure each die blade to the arcuate base plate. Manually-actuatable means adjust the adjust the securing means for selectively raising or lowering the die blade. An arcuate back-up plate is provided to which said arcuate base plate is secured. In this embodiment, the securing means comprises two spaced-apart die blade blocks supporting the die blade, each of the die blade blocks being adjustably held to the arcuate base plate by an associated die blade block bolt. Each said die blade block bolt is threadedly-secured within, and extends through, an associated die blade block. The lower edges of the die blade rest on a lower step on each die blade block. A die blade spring plate is also provided, the die blade spring plate being threadedly-secured to the arcuate base plate by a central bolt. The die blade spring plate is secured to the die blade by an indent punched out of the die blade upon which an edge of the die blade spring plate rests. The rotation of each of the die blade block bolts tends to raise or lower an associated die blade block by reaction of an end of the die blade bolts against the arcuate back-up plate. The raising of the die blade is accomplished by raising of the die blade blocks by rotating said die blade block bolts, against the reaction of the die blade spring plate, and the lowering of said die blade is accomplished by rotating the die blade block bolts in an opposite direction, the reaction of said die blade spring plate urging said die blade downwardly. In this way, the die blade spring plate substantially continuously holds said die blade to said base. The apparatus also includes a platen, the platen being cooperable with the cylindrical shell by relative movement therebetween to die cut paperboard sheets therebetween. The platen has secured thereto a like plurality of die cutting plates. Each of the die cutting plates include a spaced-apart pair of pseudo-anvils thereon, the pseudo-anvils being aligned with an associated die blade of die on the cylindrical shell.

The present invention also provides a method for die cutting an openable and closable tab in a sheet of paperboard which is to be formed into a carton. The tab includes an area bounded at least through most of its periphery by cut-score lines extending partially through the paperboard sheet from opposite sides thereof. The cut-score lines which extend into one side of the paperboard sheet are spaced inwardly of the cut-score lines which extend into the other side of the paperboard sheet and are in closely-spaced side-by-side relation thereto. An inner of two die cut-score lines is formed by a first die cutting plate and the outer of the two side-by-side cut-score lines is formed by cutting out a similar, somewhat larger area by means of a cooperating die blade of a cooperating die. Areas of the die cutting plate against which the die cutting blades force the sheet are not affected. An anvil is provided in the associated die within the area defined by a tear strip, the anvil providing a solid surface against which the cutting knife edges in the first die cutting plate, cooperate. The die cutting plate has a pair of pseudo-anvils against which the die blades of the cooperating die may cooperate. The method comprises: mutually urging a first die having die blades and a jackable anvil into engagement with a die cutting plate having a projecting cutting edge thereon which is aligned with the jackable anvil. The extent of the reverse cut-score is controlled by selective manually raising or lowering of the jackable anvil.

(c) Other Features of the Invention

By one feature of the die itself, and in respect of the anvil, the securing means combination include anvil supporting and securing means for securing the anvil to the base plate and manually-adjustable means are provided for adjusting the anvil supporting and securing means for selectively raising the anvil. By a specific feature of the die itself, and in respect of the anvil, the anvil securing means combination comprises: at least one anvil block supporting the anvil, the anvil block being adjustably held to the base plate by an anvil block bolt, rotation of the anvil block bolt tending to raise or to lower the anvil block, and an anvil spring plate, the anvil spring plate being threadedly secured to the base by a central bolt and being operatively-connected to the anvil. The raising of the anvil is accomplished by raising of the anvil block by rotating the anvil block bolt against the reaction of the anvil spring plate, the lowering of the anvil being accomplished by rotating the anvil block bolt in an opposite direction, the reaction of the anvil spring plate urging the anvil downwardly, so that the anvil spring plate substantially continuously holds the anvil to the base.

By another feature of the die itself, and in respect of the anvil, the central bolt is threadedly-secured to the base plate, and the anvil block bolt is threadedly-secured within, and extends through, the anvil block, the anvil block being raised upon rotation of the anvil block bolt, by reaction of an end of the anvil bolt against the back-up plate, the anvil block being lowered by reaction of the anvil spring plate upon opposite rotation of the anvil block bolt. By yet another feature of the die itself, and in respect of the anvil, the anvil spring plate is operatively-connected to, and is secured to the anvil by a slot in the anvil within which an edge of the anvil spring plate is disposed. By still another feature of the die itself, and in respect of the anvil, the supporting element of the securing means combination for the anvil comprises a lower step on the anvil block, the lower edge of the anvil resting on, and being separated by, the step.

By a specific feature of the die itself, and in respect of the anvil, there are two spaced-apart anvil blocks supporting the anvil. By an exemplary feature of such specific feature, the central bolt is threadedly-secured to the base plate, and two anvil block bolts are each threadedly-secured within, and extend through, an associated anvil block. Each anvil block is raised upon rotation of an associated anvil block bolt, by reaction of an end of the associated anvil block bolt against the back-up plate, the anvil blocks being lowered by the reaction of the associated anvil spring plate upon opposite rotation of the associated anvil block bolts. By still another feature of such specific feature, the anvil spring plate is operatively-connected to, and is secured to the anvil by a slot in the anvil within which an edge of the anvil spring plate is disposed. By yet another feature of such specific feature, the supporting element of the securing means combination for the anvil comprises a lower step on each anvil block, the lower edges of anvil resting on, and being separated by, the steps.

By another feature of the die itself, and in respect of the selected die blade, the securing means combination includes die blade per supporting and securing means for securing the die blade to the base plate, and manually-actuatable means are provided for adjusting the die blade supporting and securing means for selectively raising the die blade. By a specific feature of the die itself, and in respect of the selected die blade, the die blade supporting and securing means comprises at least one die blade block supporting and securing the die blade, the die blade block being adjustably held to the base plate by a die blade block bolt, rotation of the die blade block bolt tending to raise or to lower the die blade block. A die blade spring plate is threadedly-secured to the base plate by a central bolt and being operatively-connected to the anvil block. The raising of the die blade is accomplished by raising the die blade block by rotating the die blade block bolt against the reaction of the die blade spring plate, and the lowering of the die blade is accomplished by rotating the die blade block bolt in an opposite direction. The reaction of the die blade spring plate urges the die blade downwardly, so that the die blade spring plate substantially continuously holds the die blade to the base.

By yet another feature of the die itself, and in respect of the selected die blade, the central bolt is threadedly-secured to the base plate, and the die blade block bolt is threadedly-secured within, and extends through, the die blade block, the die blade block being raised upon rotation of the die blade block bolt, by reaction of an end of the die blade bolt against the back-up plate, the die blade block bolt being lowered by reaction of the die blade spring plate upon opposite rotation of the die blade bolt. By still another feature of the die itself, and in respect of the selected die blade, the die blade spring plate is operatively-connected to and is secured, to the die blade by an indent punched out of the die blade upon which an edge of the die blade spring plate rests. By another feature of the die itself, and in respect of the selected die blade, the supporting element of the securing means combination for the die blade comprises a lower step on and being supporting by, the die blade block, the lower edge of the die blade resting on the lower step.

By a specific feature of the die itself, there are two spaced-apart die blade blocks supporting the die blade. By another feature of such specific feature, the central bolt is threadedly-secured to the base, and two die blade block bolts are each threadedly-secured within, and extend through, the die blade block, the die blade block being raised upon rotation of an associated one of the die blade block bolts, by reaction of an end of an associated one of the die blade block bolts against the back-up plate the die blade block being lowered by reaction of the die blade spring plate upon opposite rotation of the die blade block bolt. By still another feature of such specific feature, the die blade spring plate is operatively-connected to and is secured, to the die blade by an indent which is punched out of the die blade, upon which an edge of the die blade spring plate rests. By yet another feature of such specific feature, the supporting element of the securing means combination for the die blade comprises a lower step on each block, the lower edge of the die blade resting on, and being supported by the steps.

By still another feature of the die, the central bolt is threadedly-secured to the base plate; the anvil block bolt is threadedly-secured within, and extends through, the anvil block; the anvil block is raised upon rotation of the anvil block bolt, by reaction of an end of the anvil bolt against the back-up plate, and is lowered by reaction of the anvil spring plate upon opposite rotation of the anvil block bolt; the central bolt is threadedly-secured to the base; the die blade block bolt is threadedly-secured within, and extends through the die blade block; and the die blade block is raised upon rotation of the die blade block bolt, by reaction of an end of the die blade bolt against the back-up plate, and is lowered by reaction of the die blade spring plate upon opposition rotation of the die blade block bolt.

By one specific further feature of such feature, the anvil spring plate is operatively-connected to, and is secured to the anvil, by a slot in the anvil within which an edge of the anvil spring plate is disposed, and the die blade spring plate is operatively connected, and is secured, to the die blade by an indent which is punched out of the die blade upon which an edge of the die blade spring plate rests. By a second specific feature of such feature, the supporting element of the securing means combination for the anvil comprises a lower step on the anvil block, a lower edge of the anvil resting on, and being supported by, the step; and the supporting element of the securing means combination for the die blade comprises a lower step on the die blade block, a lower edge of the die blade resting on and being supported by, the step. By a third specific feature of such feature, there are two spaced-apart anvil blocks supporting the anvil and two spaced-apart die blade blocks supporting the die blade.

By yet still another feature of the die, the central bolt is threadedly-secured to the base plate; each anvil block bolt is threadedly-secured within, and extends through, an associated one of the two anvil blocks; the anvil blocks are raised upon rotation in one direction of associated anvil block bolts, by reaction of an end of each anvil block bolt against the back-up plate, and is lowered by the reaction of the associated anvil spring plate upon opposite rotation of associated anvil block bolts; the central bolt is threadedly-secured to the base; one die blade block bolt is each threadedly-secured within, and extends through, one of die blade blocks; and the die blade blocks are raised upon rotation of a die blade block bolt in one direction, by reaction of an end of each of the die blade block bolts against the back-up plate and is lowered by reaction of the die blade spring plate upon opposition rotation of the die blade block bolt. By one specific feature of such feature, the anvil spring plate is operatively connected, and is secured, to the anvil by a slot in the anvil within which an edge of the anvil spring plate is disposed; and the die blade spring plate is operatively-connected, and is secured, to the die blade by an indent which is punched out of the die blade, upon which an edge of the die blade spring plate rests. By a second specific feature of such feature, the supporting element of the securing means combination for each anvil comprises a lower step on each the anvil block, the lower edges of an associated anvil resting on, and being supported by the lower step; and the supporting element of the securing means combination for each die blade comprises a lower step on each die blade block, a lower edges of an associated die blade resting on, and being supported by, the lower step.

BRIEF DESCRIPTION OF THE DRAWINGS

In the accompanying drawings.

DESCRIPTION OF PREFERRED EMBODIMENTS (a) Description of FIG. 1, 2, 3 and 7

Figure 1:
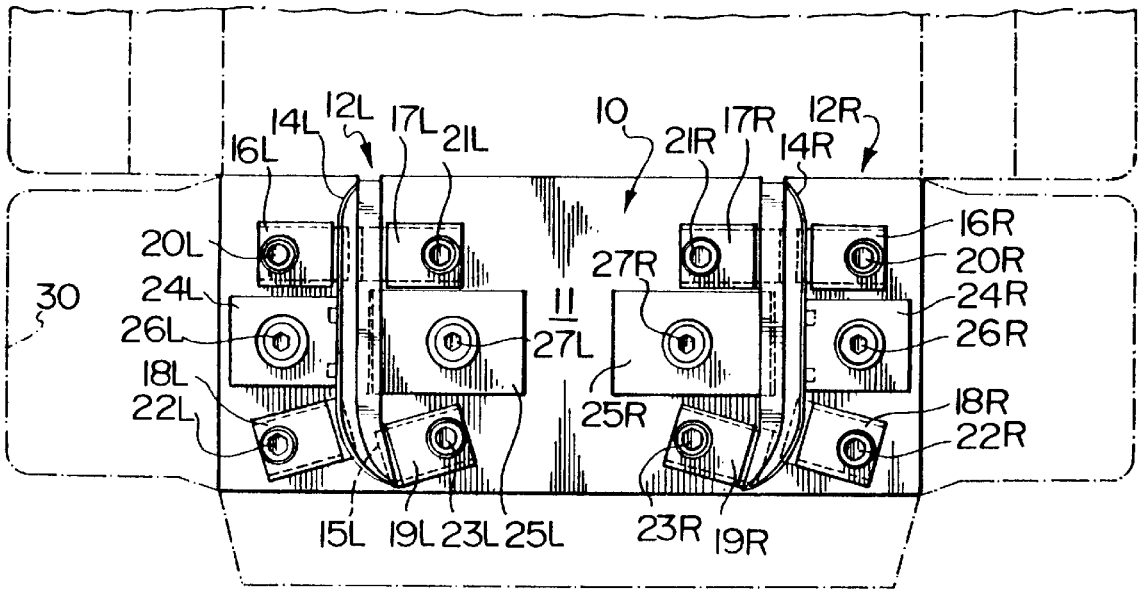
FIG. 1 is a top plan view of a pair of dies according to one embodiment of this invention, and also showing the partial outline of a carton to be die cut with dies including the pair of dies of the embodiment of the invention as shown.
Figure 2:
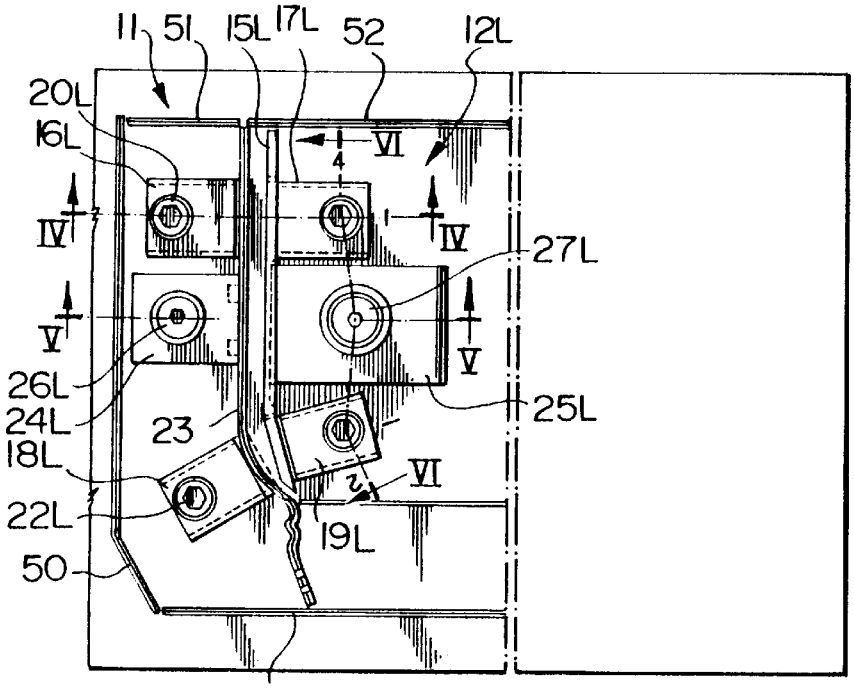
FIG. 2 is a somewhat enlarged top plan view of the left-hand die of the pair of dies shown in the embodiment of FIG. 1, the right-hand die being an identical mirror image thereof.
Figure 3:
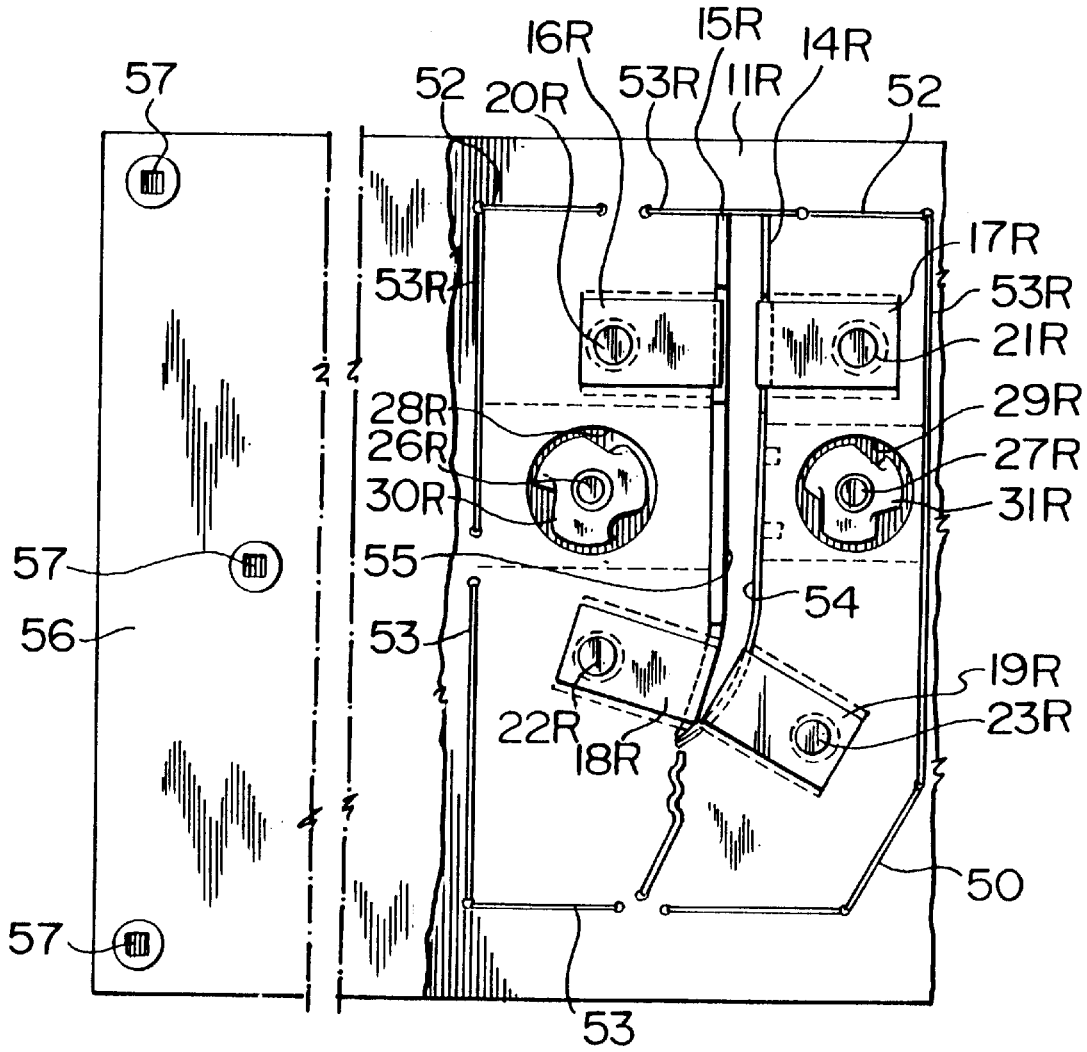
FIG. 3 is a somewhat enlarged bottom plan view of the right-hand die of the pair of dies of the embodiment shown in FIG. 1, the left-hand die being a mirror image thereof.

As seen in FIGS. 1 to 3, the pair of dies 10 of one embodiment of the invention includes a left-hand side set 12 and a right-hand side set 12R.

The left-hand side set 12 includes a jackable die blade 14 and a jackable steel bar anvil 15 which is set parallel to the die blade 14. The die blade 14 is secured to wooden block 11 by means of die blade blocks 16,18, which are held to the wooden block 11 by die blade block bolts 20, 22. The die blade 14 is retained under continual tension by means of die blade spring plate 24, which is held to the wooden block 11 by means of central bolt 26.

The steel bar anvil 15 is secured to wooden block 11 by means of anvil blocks 17, 19, which are held to the wooden block 11 by anvil block bolts 21, 23. The steel bar anvil 15 is retained under continual tension by means of anvil spring plate 25, which is held to the wooden block 11 by means of central bolt 27.

The right-hand side die set 12R is identical to, but is a mirror image of, the left-hand die set 12, and includes a jackable die blade 14R and a jackable steel bar anvil 15R which is set parallel to the die blade 14R. The die blade 14R is secured to wooden block 11 by means of die blade blocks 16R, 18R, which are held to the wooden block 11 by die blade block bolts 20R, 22R. The die blade 14R is retained under continual tension by means of die blade spring plate 24R, which is held to the wooden block 11 by means of central bolt 26R.

The steel bar anvil 15R is secured to wooden block 11 by means of anvil blocks 17R, 19R, which are held to the wooden block 11 by anvil block bolts 21R, 23R. The steel bar anvil 15R is retained under continual tension by means of anvil spring plate 25R, which is held to the wooden block 11 by means of block bolt 27R.

The outline of the carton is shown as 50. The fixed die blades are shown as 51, which are set into channels 52 in the wooden block 11 (see FIG. 3). The jackable die blade 14 is set into channel 54 in wooden block 11, while the jackable anvil 15 is set into channel 55 in wooden block 11 (see FIG. 3).

The location of the channels is accurately determined by the shape of the tab which is to be formed in the carton.

(b) Description of FIG. 3

FIG. 3 shows the underside of the wooden block 11. As seen in FIG. 3, the wooden block is secured to a steel plate 56 by means of threaded collars or pea-nuts 57.

The bases of die blade blocks 16,18, when in their lowermost position, rest on the upper surface of steel plate 56. The bases of die blade block bolts 20,22 rest on the upper surface of steel plate 56 as a reaction surface. The central bolt 26 is set within bore 28 in wooden block 11 and is secured to lock washer 30.

The bases of anvil blocks 17,19, when in their lowermost position, rest on the upper surfaces of steel plate 56. The bases of anvil block bolts 21,23 rest on the upper surface of steel plate 56 as reaction surface. The central bolt 27 is set within bore 39 in wooden block 11 and is secured to lock washer 31.

Figure 4:
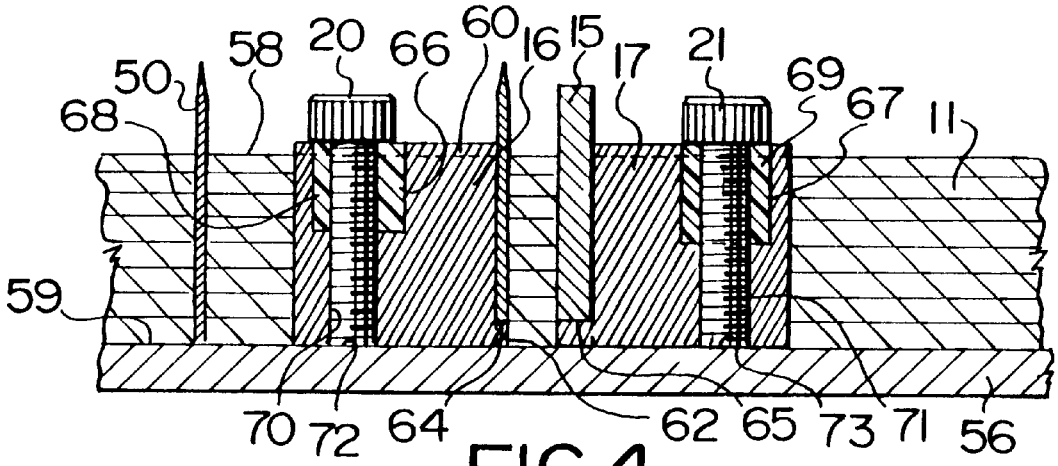
FIG. 4 is a section along the line IV—IV of FIG. 2.
Figure 5:
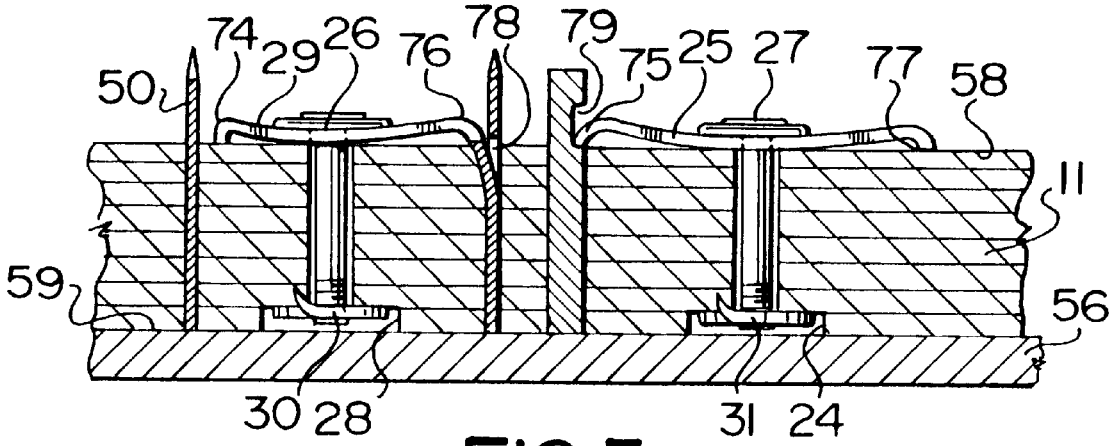
FIG. 5 is a section along the line V—V of FIG. 2.
Figure 6:
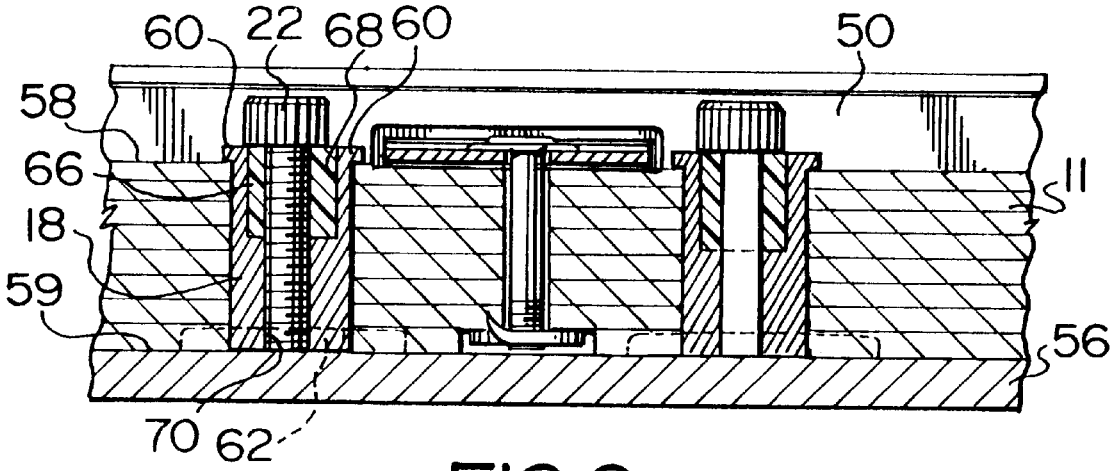
FIG. 6 is a section along the line VI—VI of FIG. 2.
Figure 7:
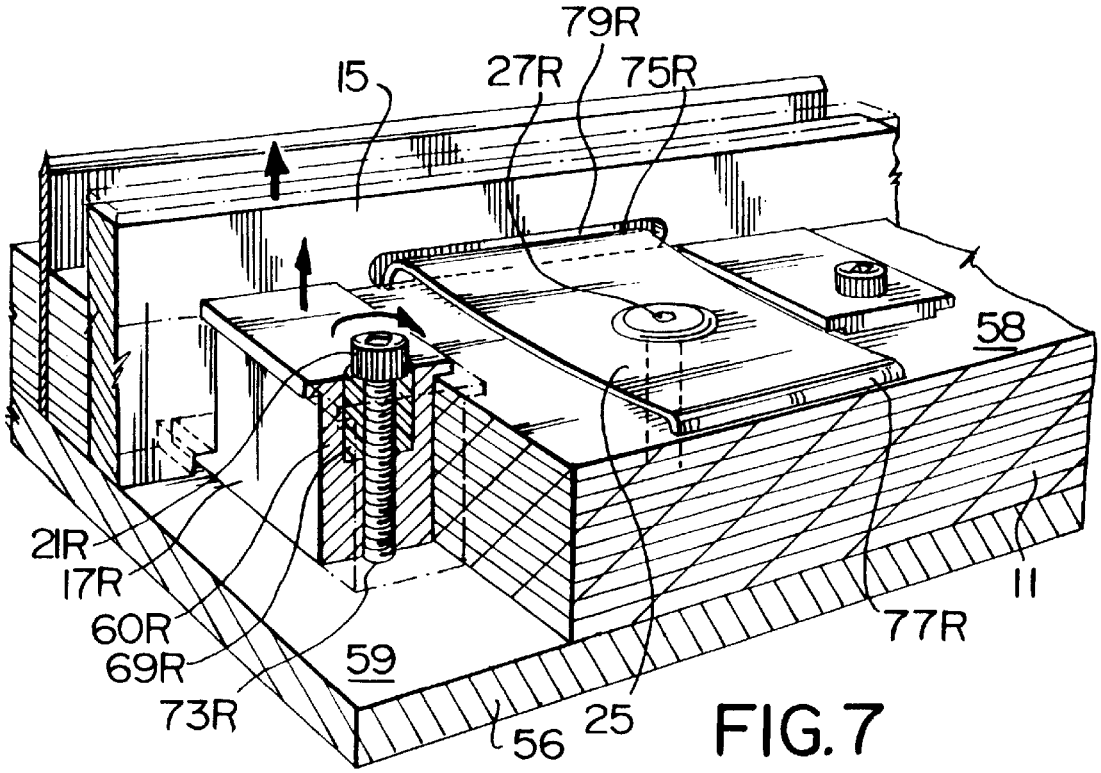
FIG. 7 is a partially-cut-away perspective view of the jack operating mechanism adjusting means for the anvil according to one embodiment of this invention as shown in FIG. 2.

(c) Description of FIGS. 4, 5, and 6

As seen more clearly in FIGS. 4 and 6, the die blade blocks 16,18 are each provided with an upper shoulder 60 to enable the die blade blocks 16,18 to rest on the top surface 58 of wooden block 11. The die blade blocks 16,18 are also each provided with a step 62 upon which the lower base 64 of die blade 14 rests. The die blade blocks 16,18 are furthermore each provided with a countersunk well 66. Each die blade block bolt 20,22 is threaded into eccentric hole 66 in plastic plug 68 until it is fully home. Then the die blade block bolt/plastic plug combination is threaded into threads 70 in die blade blocks 16,18. The lower ends 72 of die blade block bolts 20,22 rest on the upper surface 59 of the steel plate 56.

As also seen more clearly in FIGS. 4 and 6, the anvil blocks 17,19 are each provided with an upper shoulder 61 to enable the anvil blocks 17,19 to rest on the top surface 58 of wooden block 11. The anvil blocks 17,19 are also each provided with a step 63 upon which the lower base 65 of anvil 15 rests. The anvil blocks 17,19 are furthermore each provided with a countersunk well 67. Each anvil block bolt 21,23 is threaded into eccentric hole 67 in plastic plug 69 until it is fully home. Then the anvil block bolt/plastic plug combination is threaded into threads 71 in anvil blocks 17,19. The lower ends 73 of anvil block bolts 21,23 rest on the upper surface 59 of the steel plate 56.

FIG. 5 shows in detail how the jackable die blade 14 and the jackable anvil 15 are retained under constant tension.

Central bolt 26 holds die blade spring plate 24 by means of engagement with lock washer 30. Die blade spring plate 24 has an outer skirt 74 resting atop the top surface 58 of wooden block 11 and an inner skirt 76 resting on indent 78 punched out of die blade 14. It is noted that the central portion of die plate 14 rests with its base 64 on the upper surface 59 of the steel plate 56. The lateral portions of die blade 14 are stepped so that its lateral lower ends 64 can rest on steps 62.

Central bolt 27 holds anvil spring plate 25 by means of engagement with lock washer 31. Anvil spring plate 25 has an outer skirt 75 resting atop tipper surface 58 of wooden block 11 and an inner skirt resting in slot 79 formed in jackable anvil 15. It is noted that the central portion of jackable anvil 15 rests with its base 65 on the upper surface 59 of steel plate 56. The lateral portions of the anvil 15 are stepped so that its lateral, lower end 65 can rest on steps 63.

Figure 8:
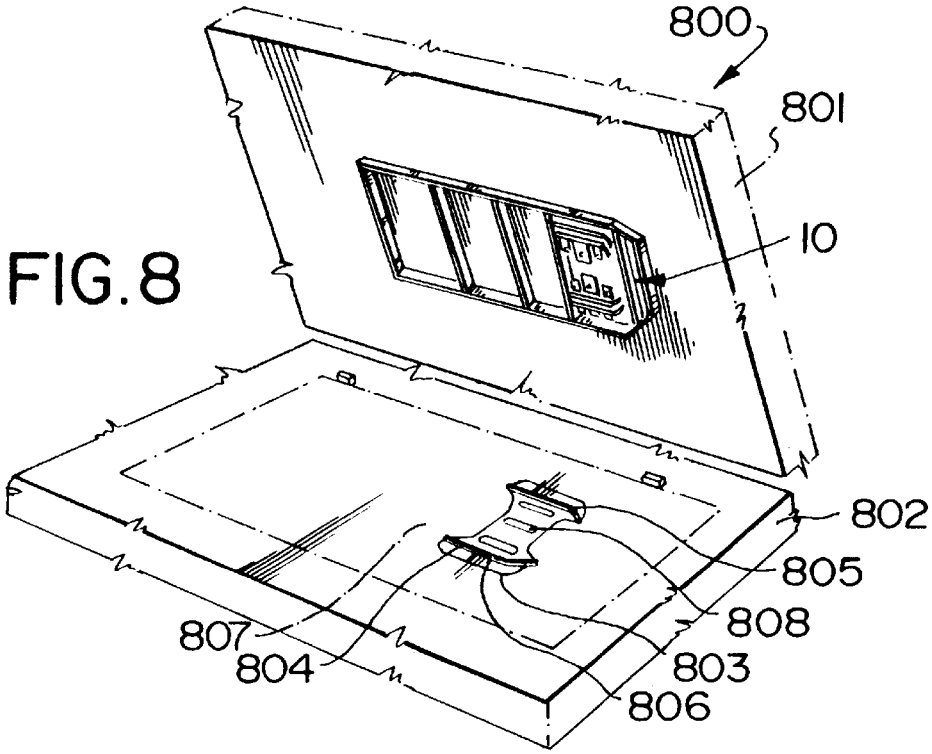
FIG. 8 is a fragmenting perspective view of a die according to an embodiment of this invention in an apparatus for making die cut cartons including a reverse cut-score.

(d) Description of FIG. 8

As seen in FIG. 8, a simplified cutting tool 800 includes an upper or fixed platen 801 to which is secured one die unit 10. However, in commercial practice, there would be sixteen such die units or clones 10 secured to upper platen 801.

The apparatus 800 also includes a lower or movable platen 802, to which is secured a lower die plate 803. Since there would normally be sixteen die units or clones 10 secured to upper platen 801, there would, similarly, be sixteen such lower die plates 803 secured to lower platen 802.

The lower die plate 803 is provided with a pair of transversely-spaced-apart knife edges 804,805 which are situated below the anvils of the upper die unit 10. The lower die plate 803 also includes a pair of outer, lateral, pseudo-anvils 806,807. The pseudo-anvils are disposed below the die blades of the upper die unit 10.

A threaded collar or pea-nut secures the die sets 10 to the upper fixed platen 801. Suitable securing means cooperating with slots 808 in the lower die plate 803 secures the lower die plate 803 to the lower (movable) platen 802. The die blade of the upper die 10 and the knife edges of the lower die plate 803 have a raised cutting edge of about $^{25}/_{1000}$". The anvils and the die blades of each of the upper dies 10 can be raised or lowered about $^{6}/_{1000}$" to about $^{7}/_{1000}$" by ½ turn of the block bolt.

Figure 9:
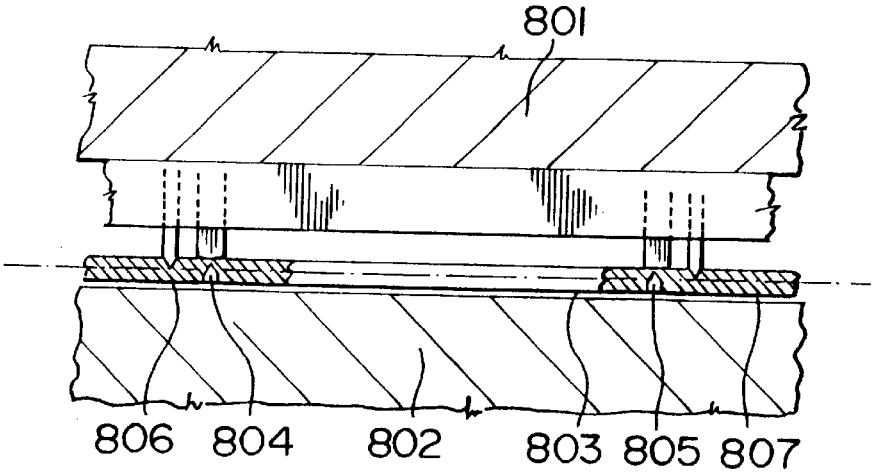
FIG. 9 is a fragmentary longitudinal section showing the formation of a reverse cut-score using a die according to an embodiment of this invention as shown in FIG. 8.

(e) Description of FIG. 9

As seen in FIG. 9, the lower (movable) platen 802 has moved towards the upper (fixed) platen 801 to enable the die sets 10, and the lower die plate 803 to cooperate to provide the reverse cut scores. As will be seen, the knives 804,805 of the die plate 803 on the lower (movable) platen 802 are aligned with the anvils of the die 10 on the upper (fixed) platen 801. The die blades of the die sets 10 on the upper (fixed) platen 801 are aligned with the pseudo-anvils 806, 807 of the die plate on the lower (movable) platen 802. The partial (half-way) cuts are clearly seen, which provides the reverse cut-scores.

Figure 10:
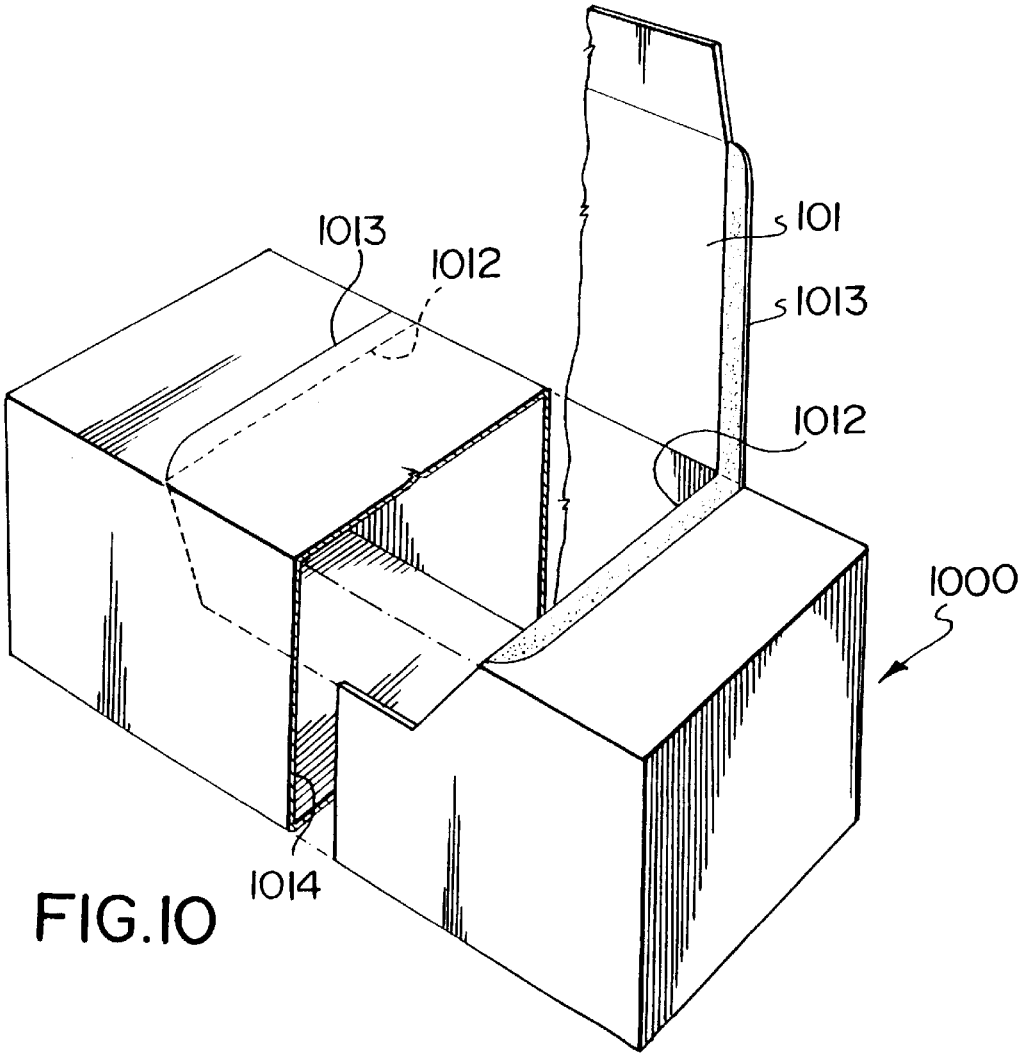
FIG. 10 is a perspective view of a carton including a reclosable tab formed with the reverse cut-score using the die of an embodiment of the invention.

(f) Description of FIG. 10

The openable and closable tab 1010 formed by the system of this invention, the operation of which is schematically illustrated in FIG. 9, is shown in FIG. 10. The carton 1000 includes an openable and closable tab 1010. To form such tab 1010, the inner 1012 of the two die cut lines is formed by a lower die plate 803 and the outer 1013 of the two side-by-side lines 1012, 1013 is formed by cutting out a similar, somewhat larger area using the upper die set 10. The anvils and pseudo anvils are provided on the die sets 10 and dies plates 803 respectively, within the area defined by the tab 1010. These anvils and pseudo-anvils provide a solid surface against which the respective die blades and knife edges may cooperate. The cutting is at the back of the paperboard, i.e., it provides a reverse cut-score. The paperboard 1014 is cut halfway through from the top and, in a slightly laterally offset manner, halfway from the bottom. When the paperboard 1014 is torn away along the lines 1012,1013, an openable and reclosable tab 1010 is formed.

(g) Description of FIGS. 11 to 14

FIGS. 11 to 14 show four alternative jackable structures to raise and lower the anvils and/or the die blade. The following description refers to the anvils but the structures apply equally for use with the die blades.

Figure 11:
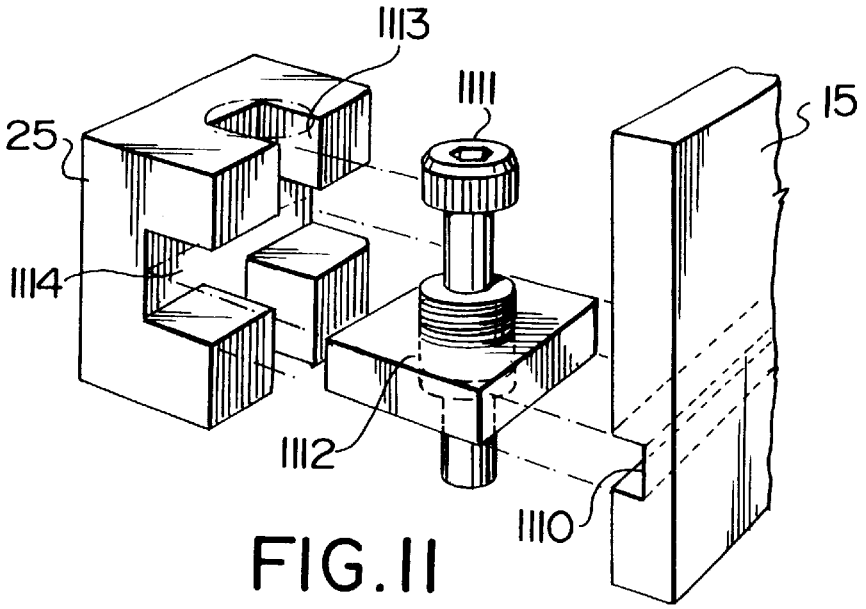
FIG. 11 is an exploded schematic partial view of another jack operating mechanism according to another embodiment of this invention for raising and lowering the anvil.

As seen in FIG. 11, the anvil 15 is provided with a longitudinal, lower cam channel 1110. An adjustment bolt 1111 is threadedly-secured within a follower plate 1112. Adjustment bolt 1111 is fitted within a steel block 25 having a vertical channel 1113 and a horizontal channel 1114.

Rotation of the bolt with respect to the steel block 25 raises or lowers the following plate 1112 which in turn raises or lowers the cam channel 1110. In this way, the anvil 15 moves in a purely vertical upward or downward movement, and thus prevents skewing movement of the anvil 15.

Figure 12:
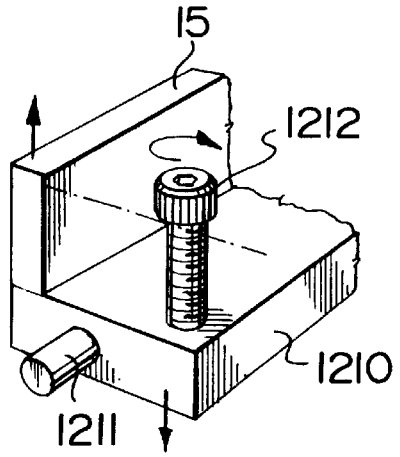
FIG. 12 is a schematic partial view of yet another jack operating mechanism according to another embodiment of this invention for raising and lowering the anvil.

As seen in FIG. 12, the steel block (not seen) supporting the anvil 15 includes a support plate 1210 which is pivotally-movable around a rotation shaft 1211. The machine bolt 1212 extends through the steel block and the support plate 1210 as well and its lower end abuts the steel plate previously described. Rotation of the bolt 1212 causes the support plate 1210 to be pivotally-raised or lowered about the rotation shaft 1211. In this way, the anvil 15 moves in a purely vertical upward or downward movement, and thus prevents skewing movement of the anvil or knife.

Figure 13:
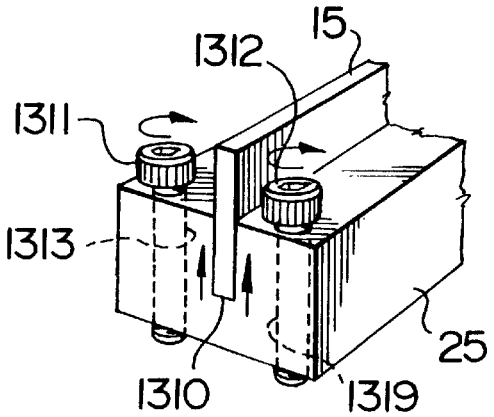
FIG. 13 is a schematic partial view of still another jack operating mechanism according to another embodiment of this invention for raising and lowering the anvil.

The variant shown in FIG. 13 shows the block 25 provided with a central longitudinally-extending channel 1310 within which the anvil 15 rests. Two machine bolts 1311, 1312 are threaded into tapped apertures 1313,1314 which are provided one on each side of the central channel 1310. Since turning both machine bolts is required to raise or lower the steel block 25, the steel block 25 is raised and lowered in a purely vertical upward or downward movement, and this prevents skewing movement of the anvil.

Figure 14:
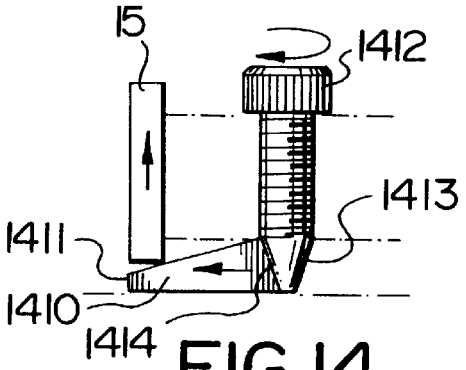
FIG. 14 is a schematic partial view of a still further jack operating mechanism according to another embodiment of this invention for raising and lowering the anvil.

The variant shown in FIG. 14 provides a slidable ramp 1410 disposed transversely within the steel block (not seen), the ramp 1410 having an angle of attack of 1° to 5°. The anvil 15 rests on the tip 1411 of the ramp 1410. The machine bolt 1412 which is threaded vertically in the tapped hole (not seen) in the steel block (not seen) is provided with a frusto-conical end 1413. This frusto-conically angled end 1413 contacts the angled edge 1414 at the higher end of the ramp 1410.

Turning of the bolt 1412 causes the ramp 1410 to move truly horizontally, which translate into an increased thickness of the ramp 1410 below the anvil 15. In this way, the anvil 15 moves in a purely vertical upward or downward movement, and this prevents skewing movement of the anvil 15.

Figure 15:
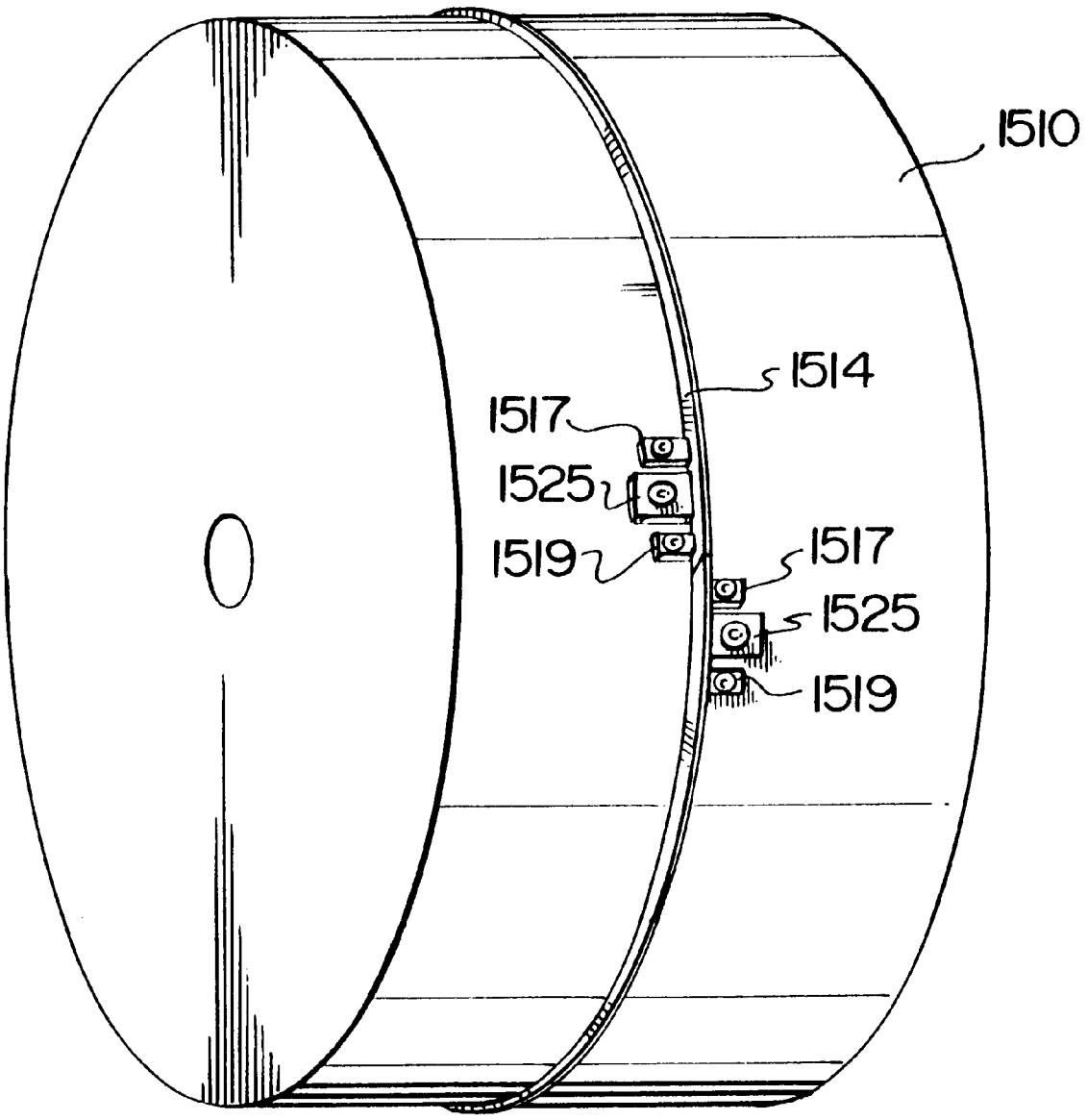
FIG. 15 is a view of a perspective view of a drum die showing a mechanism, according to an embodiment of this invention, for securing a blade in the drum die.

(h) Description of FIG. 15

FIG. 15 shows the use of the anvil jack system of blocks 1517,1519 and spring plate 1525 for holding an endless blade 1514 to a rotary cylinder 1510 for a cardboard box fabricating machine. The movable steel blocks 1517,1519 and the retaining spring plate 1525 are the same as has been previously described with respect to FIGS. 1 to 7 and so will not be further described herein.

OPERATION OF PREFERRED EMBODIMENT (a) Operation of Embodiments of FIGS. 1–7

With respect to the anvil, because the anvil block bolt is threaded into the eccentric plastic collar first, and then into the threads of the steel block, the anvil block bolt is constantly under bending pressure. This provides a self-locking action regardless of the rotational position of the anvil block bolt. Since the anvil block bolt is not free to rotate, this keeps the anvil in position whenever it is raised or lowered.

With respect to the die blade, because the die blade block bolt is threaded into the eccentric plastic collar first, and then into the threads of the steel block, the die blade block bolt is constantly under bending pressure. This provides a self-locking action regardless of the rotational position of the die blade block bolt. Since the die blade block bolt is not free to rotate, this keeps the die blade in position whenever it is raised or lowered.

With respect to the securing of the die blade spring plate to the die blade and to the wooden block, the downwardly-depending forward edge of the die blade spring plate is engaged with the indents on the die blade. The central bolt then passes through the central aperture in the die blade spring plate and through a steel collar through the wooden block to be engaged by a lower lock nut/washer inset within a countersunk hole in the lower base of the wooden block. Tightening of the central bolt urges the die blade spring plate into tension with the rear depending portion thereof pressed against the top face of the wooden block.

Thus, the die blade spring plate urges and draws the die blade onto the wooden block and traps the die blade within the die. The central bolt has a niche in it to provide a starting point.

With respect to the securing of the anvil spring plate to the anvil and to the wooden block, the downwardly-depending forward edge of the anvil spring plate is engaged within the transverse slot in the anvil. The central bolt then passes through the central aperture in the anvil spring plate and through a steel collar through the wooden block to be engaged by a lower lock nut/washer inset within a countersunk hole in the lower base of the wooden block. Tightening of the central bolt urges the anvil spring plate into tension with the rear depending portion thereof pressed against the top face of the wooden block.

Thus, the anvil spring plate urges and draws the anvil onto the wooden block and traps the anvil within the die. The central bolt has a niche in it to provide a starting point.

In operation, to control the height of the die blade, turning one die blade block bolt raises the die blade steel block at one end of the die blade by the reaction of the die blade bolt against the steel base plate. Turning the other die blade block bolt in the same direction raises the die blade steel block at the other end of the die blade. Since the die blade rests on the steps of both of the die blade steel blocks, this raises the die blade as well. Raising the die blade flexes the die blade steel spring and increases the tension on the die blade steel spring. Turning the die blade bolts in the opposite direction lowers the die blade by the downward force due to the tension on the die blade steel spring. The tension in the die blade steel spring holds the die blade in the raised or lowered position.

The die blade block bolts are so adjusted that, when turned, they raise or lower the die blade by one-thousandth of an inch per quarter turn. Index digits 1, 2, 3, 4, are provided in the wooden block to assist in adjustment of the die blade block bolts.

In operation, to control the height of the anvil, turning one anvil block bolt raises the anvil steel block at one end of the anvil by the reaction of the anvil block bolt against the steel base plate. Turning the other anvil block bolt in the same direction raises the anvil steel block at the other end of the anvil. Since the anvil rests on the steps of both of the anvil steel blocks, this raises the anvil as well. Raising the anvil flexes the anvil steel spring and increases the tension on the anvil steel spring. Turning the anvil block bolts in the opposite direction lowers the anvil by the downward force due to the tension on the anvil steel spring. The tension in the anvil steel spring holds the anvil in the raised or lowered position.

The anvil block bolts are so adjusted that, when turned, they raise or lower the anvil by one-thousandth of an inch per quarter turn. Index digits 1, 2, 3, 4, are provided in the wooden block to assist in adjustment of the anvil block bolts.

CONCLUSION

As noted above, the anvils and/or die blades are independently adjustable to within about 0.005" by means of the socket head or machine screws (i.e., the die blade block bolts, and/or the anvil block bolts). It is possible to adjust the cutting depth of these anvils and/or die blades independently of one another. The reduced set up time of die presses increases the life of the die and minimizes die repairs.

A feature of the present invention resides in the provision of an anvil into the die which is supported upon the movable platen against which die cutting edges project through the die cutting plate may operate. This anvil is so arranged that the exposed surface of the anvil is spaced from the surface of the die cutting plate.

An anvil spring plate is secured in a slot in the anvil adjacent a machine bolt which is threaded into a threaded collar. The anvil spring plate thus urges and draws the anvil into the back-up plate and traps the anvil into the die. At the reverse side, anvil steel bolts protrude through the block and press the back-up plate to the block. A threaded collar or pea-nut secures the dies to the cutting tool. A screw or machine anvil bolt may be turned at the top-back to raise or lower the anvil about one thousandth of an inch per quarter turn.

According to the system of this invention, the inner of the two die cut lines is normally formed by a lower die cutting plate and the outer of the two side-by-side die cut lines is formed by cutting out a similar, somewhat larger, area in the upper die. This is done so that the areas of the die cutting plate against which the die cutting blade in the upper die force the sheet will not be affected. An anvil is provided in the upper die within the area defined by the tear strip and this anvil provides a solid surface against which the cutting knife edges in the lower die cutting plate, cooperate. The lower die cutting plate has a surface termed as pseudo-anvil against which the die blades of the upper die may cooperate.

The anvils and/or knives are independently adjustable to within about 0.005" by means of a respective die blade or anvil socket head screw or machine bolt. These are used to raise (jack) and lower the respective cutting anvil (bar) which is a steel bar and/or the die blades by one-half of a thousandth of an inch. It is possible to adjust the cutting depth of these anvils and/or die blades independently of one another. The anvils and/or die blades are adjustable from either end. The conjoint use of the upper anvils and the lower knife edges provides a reverse cut-score.

This die is used to make a cardboard carton which can be sealed shut, torn open at the reverse cut-score and then reclosed and opened a plurality of times. The reverse cut-score is carried out by means of the metal plate knife edges on the lower die cutting plate with a raised cutting edge of about $^{25}/_{1000}$", acting against the anvil.

The method of adjusting the cutting anvils to raise or lower the cutting pressure, which results in a reverse cut scoring, involves turning the anvil socket head screws or machine bolts ½ turn for each about 6 to about 7 one thousandth of an inch. The cutting is at the back of the cardboard, i.e., it provides a reverse cut-score. The cardboard is cut halfway through from the top and, in a slightly laterally offset manner, halfway from the bottom. When the cardboard is torn away along the cut line, an openable and reclosable tab is formed.

The following are some of the advantages of this invention:

(a) Numbers are provided on the back-up block to assist in adjustment, and the machine bolt has a niche on it to provide a starting point.

(b) Generally, the production load would have sixteen die units or clones, and the machine is adapted to carry out about 7000 to about 10,000 impressions per hour.

(c) Adjustment of the reverse cut-scores and main scores are independent of each other in both the positive and the negative direction.

(d) Adjustment of reverse cut-scores and main scores are independent of the die make-ready, and are adjustable to about 0.001".

(e) There is a much higher level of cutting stability by the reverse cut-scores and main scores.

(f) The dies maintain an even balance.

(g) There is more positive and faster adjustment because of the steel on steel action.

(h) The system eliminates the transfer effect created when using the prior technique of the use of tape.

(i) The spongy compression variable effect due to the use of make-ready tape has been eliminated.

(j) The system is not affected by the foot print of the press.

(k) The system eliminates additional crease pressure and damage to the cut at the intersection of the reverse cut-score, the main score, the crease and the wave cut rule caused by existing conventional method.

(l) The blades and anvils can be fine tuned during the run to accommodate any changes in stock density, composition or moisture content, thereby providing more consistency over a long run.

(m) The cut to cut ratio of the opening feature can be better maintained.

(n) The system eliminates the need for frequent re-knives.

(o) The system eliminates the preparation of a new spot sheet each time the job goes to press as was the case when done conventionally.

(p) The original spot sheet can be re-used, and no set-up but only fine tuning is required on repeat order.

(q) The system allows the optimum operation of the opening feature which is achievable with optimum operation and the quality of the opening feature can be maintained.

(r) The system can be confidently used with paperboard having a thickness of about 0.016".

(s) No special operator skills are required since set-up is first done conventionally, and then the system of this invention is used to complete the setting.

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. A die for use in an apparatus for die cutting both sides of paper-board sheets, said die comprising:

(i) a base plate;

(ii) a plurality of cutting knives projecting from said base plate, said knives being set into a preselected pattern of grooves within said base plate;

(iii) a die blade which is secured to said base plate;

(iv) an anvil, which is secured to said base plate, said anvil being oriented substantially parallel to said die blade;

wherein at least one of said die blade and said anvil is secured in a securing means combination, one supporting element of said securing means combination supporting said at least one of said die blade and said anvil an urging element of said securing means combination urging said at least one of said die blade and said anvil in a downward direction, said securing means combination permitting upward and downward movement of said at least one of said die blade and said anvil relative to said base plate;

(iv) manually-actuatable means for acting on said one supporting element of said securing means combination for raising said supporting element against the reaction of said urging element for selectively raising said at least one of said die blade and said anvil; and (v) a back-up plate to which said base is secured.

2. The die of claim 1 wherein said securing means combination includes anvil supporting and securing means for supporting and securing said anvil to said base plate; and including manually-actuatable means for adjusting said anvil supporting and securing means for selectively raising said anvil.

3. The die of claim 2 wherein said supporting and securing means combination comprises at least one anvil block supporting said anvil, said anvil block being adjustably held to said base plate by an anvil block bolt, rotation of said anvil block bolt tending to raise or to lower said anvil block; and an anvil spring plate, said anvil spring plate being threadedly secured to said base by a central bolt and being operatively-connected to said anvil; the raising of said anvil being accomplished by raising of said anvil block by rotating said anvil block bolt in one direction by reaction of an end of said anvil bolt against said back-up plate, against the reaction of said anvil spring plate; the lowering of said anvil being accomplished by rotating said anvil block bolt in an opposite direction, the reaction of said anvil spring plate urging said anvil downwardly; whereby said anvil spring plate substantially-continuously holds said anvil to said base.

4. The die of claim 3 wherein said central bolt is threadedly-secured to said base plate; and wherein said anvil block bolt is threadedly-secured within, and extends through, said anvil block; said anvil block being raised upon rotation of said anvil block bolt in one direction, by reaction of an end of said anvil bolt against said back-up plate against the reaction at said anvil spring plate, said anvil block being lowered by reaction of said anvil spring plate upon opposite rotation of said anvil block bolt.

5. The die of claim 3 wherein said anvil spring plate is operatively-connected, and is secured to said anvil by a slot in said anvil within which an edge of said anvil spring plate is disposed.

6. The die of claim 3 wherein said supporting element of said securing means combination for said anvil comprises a lower step on said anvil block, a lower edge of said anvil resting on, and being supported by, said step.

7. The die of claim 3 comprising two spaced-apart anvil blocks supporting said anvil.

8. The die of claim 7 wherein said central bolt is threadedly-secured to said base plate; and wherein each anvil block bolt is threadedly-secured within, and extends through, one of said two anvil blocks; said anvil blocks being raised upon rotation in one direction of an associated one of said anvil block bolts, by reaction of an end of each said anvil block bolt against said back-up plate against the reaction of an associated said anvil spring plate; said anvil blocks being lowered by said reaction of said associated anvil spring plate upon opposite rotation of associated said anvil block bolts.

9. The die of claim 7 wherein each anvil spring plate is operatively connected, and is secured to, an associated said anvil by a slot in said anvil within which an edge of said anvil spring plate is disposed.

10. The die of claim 7 wherein said supporting element of said securing means combination for each said anvil comprises a lower step on each said anvil block, a lower edge of an associated said anvil resting on, and being supported by, said lower step.

11. The die of claim 1 wherein said securing means combination includes die blade supporting and securing means for supporting and securing said die blade to said base plate; and including manually-actuatable means for adjusting said die blade supporting means for selectively raising said die blade.

12. The die of claim 11 wherein said die blade supporting and securing means comprises: at least one die blade block supporting and securing said die blade, said die blade block being adjustably held to said base plate by a die blade block bolt, rotation of said die blade block bolt tending to raise or to lower said die blade block; and a die blade spring plate, said die blade spring plate being threadedly secured to said base by a central bolt and being operatively-connected to said anvil block; the raising of said die blade being accomplished by raising of said die blade block by rotating said die blade block bolt in one direction by reaction of an end of said die blade bolt against said back-up plate, against the reaction of said die blade spring plate; the lowering of said die blade being accomplished by rotating said die blade block bolt in an opposite direction, the reaction of said die blade spring plate urging said die blade downwardly; whereby said die blade spring plate substantially-continuously holds said die blade to said base plate.

13. The die of claim 12 wherein said central bolt is threadedly-secured to said base plate; and wherein said die blade block bolt is threadedly-secured within, and extends through said die blade block; said die blade block being raised upon rotation of said die blade block bolt in one direction, by reaction of an end of said die blade bolt against said back-up plate against the reaction of said anvil spring plate; said die blade block bolt being lowered by reaction of said die blade spring plate upon opposition rotation of said die blade block bolt.

14. The die of claim 12 wherein said die blade spring plate is operatively connected, and is secured to, said die blade by an indent which is punched out of said die blade upon which an edge of said die blade spring plate rests.

15. The die of claim 12 wherein said supporting element of said securing means combination for said die blade comprises a lower step on said die blade block, a lower edge of said die blade resting on and being supported by, said step.

16. The die of claim 12 comprising two spaced-apart die blade blocks supporting said die blade.

17. The die of claim 16 wherein said central bolt is threadedly-secured to said base; and wherein each die blade block bolt is threadedly-secured within, and extends through, one of two die blade blocks; said die blade blocks being raised upon rotation of a die blade block bolt, by reaction of an end of each of said die blade block bolts against said back-up plate against the reaction of an associated said die blade spring plate; said die blade block being lowered by reaction of said die blade spring plate upon opposition rotation of said die blade block bolt.

18. The die of claim 16 wherein each die blade spring plate is operatively-connected, and is secured to, said die blade by an indent which is punched out of an associated said die blade, upon which an edge of said die blade spring plate rests.

19. The die of claim 16 wherein said supporting element of said securing means combination for each said die blade comprises a lower step on each said die blade block, a lower edge of an associated said die blade resting on, and being supported by, said lower step.

20. The die of claim 1 wherein said securing means combination comprises anvil supporting and securing means for supporting and securing said anvil to said base plate; and including manually-actuatable means for adjusting said anvil supporting means for selectively raising said anvil; also comprising die blade supporting and securing means for supporting and securing said die blade to said base; and including manually-actuatable means for adjusting said die blade securing means for selectively raising or lowering said die blade.

21. The die of claim 20 wherein said anvil supporting and securing means combination comprises at least one anvil block supporting and securing said anvil, said anvil block being adjustably held to said base plate by an anvil block bolt, rotation of said anvil block bolt tending to raise or to lower said anvil block, and an anvil spring plate, said anvil spring plate being threadedly-secured to said base by a central bolt and being operatively-connected to said anvil, the raising of said anvil being accomplished by rotating said anvil block bolt in one direction by reaction of an end of said anvil block bolt against said back-up plate, against the reaction of said anvil spring plate, the lowering of said anvil being accomplished by rotating said anvil block bolt in an opposite direction, the reaction of said anvil spring plate urging said anvil downwardly, wherein said anvil spring plate substantially-continuously holds said anvil to said base plate; and wherein said die blade securing means comprises at least one die blade block supporting and securing said die blade, said die blade block being adjustably held to said base base plate by a die blade block bolt, rotation of said die blade block bolt tending to raise or to lower said die blade block, and a die blade spring plate, said die blade spring plate being threadedly-secured to said base by a central bolt and being operatively-connected to said anvil blade, the raising of said die blade being accomplished by rotating said die blade block bolt, in one direction by reaction of an end of said die blade block bolt against said back-up plate against the reaction of said die blade spring plate, the lowering of said die blade being accomplished by rotating said die blade block bolt in an opposite direction, the reaction of said die blade spring plate urging said die blade downwardly, whereby said die blade spring plate substantially continuously holds said die blade to said base.

22. The die of claim 20 wherein said central bolt is threadedly-secured to said base plate; wherein said anvil block bolt is threadedly-secured within, and extends through, said anvil block; wherein said anvil block is raised upon rotation of said anvil block bolt, by reaction of an end of said anvil bolt against said back-up plate against the reaction of said anvil spring plate, and is lowered by reaction of said anvil spring plate upon opposite rotation of said anvil block bolt; wherein said central bolt is threadedly-secured to said base; wherein said die blade block bolt is threadedly-secured within, and extends through said die blade block; and wherein said die blade block is raised upon rotation of said die blade block bolt, by reaction of an end of said die blade bolt against said back-up plate against the reaction of said die blade spring plate and is lowered by reaction of said die blade spring plate upon opposition rotation of said die blade block bolt.

23. The die of claim 20 wherein said anvil spring plate is operatively-connected, and is secured to, said anvil by a slot in said anvil within which an edge of said anvil spring plate is disposed; and wherein said die blade spring plate is operatively connected, and is secured to, said die blade by an indent which is punched out of said die blade upon which an edge of said die blade spring plate rests.

24. The die of claim 20 wherein said supporting element of said securing means combination for said anvil comprises a lower step on said anvil block, a lower edge of said anvil resting on, and being supported by, said step; and wherein said supporting element of said securing means combination for said die blade comprises a lower step on said die blade block, a lower edge of said die blade resting on, and being supported by, said step.

25. The die of claim 20, comprising two spaced-apart anvil blocks supporting said anvil and comprising two spaced-apart die blade blocks supporting said die blade.

26. The die blade of claim 25, wherein each said central bolt is threadedly-secured to said base plate; wherein each anvil block bolt is threadedly-secured within, and extends through an associated, one of said anvil two anvil blocks; wherein said anvil blocks are raised upon rotation of associated said anvil block bolts, by reaction of an end of each said anvil block bolt against said back-up plate against the reaction of said anvil spring plate, and are lowered by said reaction of said associated anvil spring plate upon opposite rotation of associated said anvil block bolts; wherein said central bolt is threadedly-secured to said base; wherein each die blade block bolt is threadedly-secured within, and extends through an associated one of said die blade blocks; and wherein said die blade blocks are raised upon rotation of a die blade block bolt in one direction, by reaction of an end of an associated one of said die blade block bolts against said back-up plate against the reaction of said die blade spring plate, and are lowered by reaction of said die blade spring plate upon opposition rotation of said die blade block bolt.

27. The die of claim 25, wherein said anvil spring plate is operatively connected, and is secured to, each said anvil by a slot in each said anvil within which an edge of said anvil spring plate is disposed; and wherein said die blade spring plate is operatively-connected, and is secured to, each said die blade by an indent which is punched out of each said die blade, upon which an edge of said die blade spring plate rests.

28. The die of claim 25, wherein said supporting element of said securing means combination for each said anvil comprises a lower step on each said anvil block and wherein a lower edge of each said anvil rests on, and is supported by, said lower step; and wherein said supporting element of said securing means combination for said die blade comprises a lower step on each said die blade block, a lower edge of each of said die blade resting on, and being supported by, said lower step.

* * * * *